United States Patent [19]

Ochoa

[11] 4,311,026

[45] Jan. 19, 1982

[54] COMPOSITE FINGER RING AND METHOD OF MAKING SAME

[75] Inventor: Enrique J. Ochoa, Palm Beach, Fla.

[73] Assignee: Jewelmasters, Inc., Palm Beach, Fla.

[21] Appl. No.: 168,207

[22] Filed: Jul. 10, 1980

[51] Int. Cl.[3] ..... A44C 9/00; B23P 11/00

[52] U.S. Cl. ..... 63/15; 29/160.6

[58] Field of Search ..... 63/15, 15.1, 15.2, 15.3, 63/15.4, 26, 27, 28, 3; 29/160.6, 8

[56] References Cited

U.S. PATENT DOCUMENTS

| | | | |
|---|---|---|---|
| 1,186,271 | 6/1916 | Block | 63/15.2 |
| 1,265,679 | 5/1918 | Kropé | 63/15.2 |
| 1,986,223 | 1/1935 | Conner | 63/3 X |
| 2,016,679 | 10/1935 | Mayer | 63/15.1 |
| 2,105,227 | 1/1938 | Richter | 63/15 |
| 2,140,396 | 12/1938 | Whitaker | 29/160.6 X |

*Primary Examiner*—F. Barry Shay

*Attorney, Agent, or Firm*—Charles E. Temko

[57] ABSTRACT

A bezel type finger ring formed of plural cast parts which are interconnected by soldering or pinning to form a composite article. The construction includes a circular bezel member, a bezel insert member and a ring element supporting the bezel member formed as three separate ring members.

3 Claims, 3 Drawing Figures

COMPOSITE FINGER RING AND METHOD OF MAKING SAME

BACKGROUND OF THE INVENTION

This invention relates generally to the field of jewelry, and more particularly to an improved form of bezel type finger ring and method of making the same.

It is known in the art to form the band portion of a ring to include a tubular base member upon which a plurality of decorative circular members are affixed. In the United States patent to Spaney, U.S. Pat. No. 1,178,186, granted Apr. 4, 1916, this concept is utilized employing an original engagement ring as a component. A similar construction, using a base member, is taught by the patent to Eliasoff, U.S. Pat. No. 1,599,811, granted Sept. 14, 1926.

The concept of forming a finger ring to include a bezel is also known, and is exemplified by the patent to Bonagura, U.S. Pat. No. 2,653,402 of Sept. 29, 1953.

SUMMARY OF THE INVENTION

Briefly stated, the invention contemplates the provision of an easily assembled composite ring structure, which will, by virtue of assembly, simulate a miniature wristwatch, including a metallic band. By forming the individual components to the configuration of corresponding components of a watch, these components may be substituted by similar components of different colors, patterns, or surface ornamentation to closely simulate existing watchband variants. The bezel component does not contain a watch movement or simulated face, but forms a recess for the reception of a precious stone setting or a signet plate or the like. The components are provided with assembly pin members that fit corresponding openings in the components which enable fitting to relatively close tolerances.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
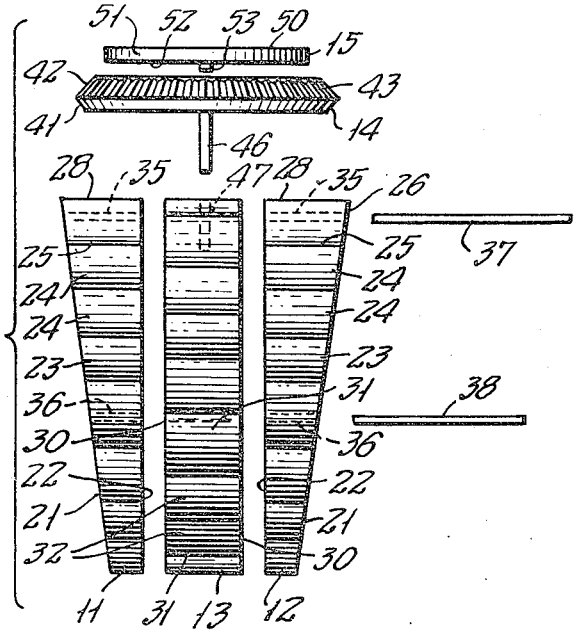
FIG. 1 is an exploded side elevational view of an embodiment of the invention.
Figure 2:
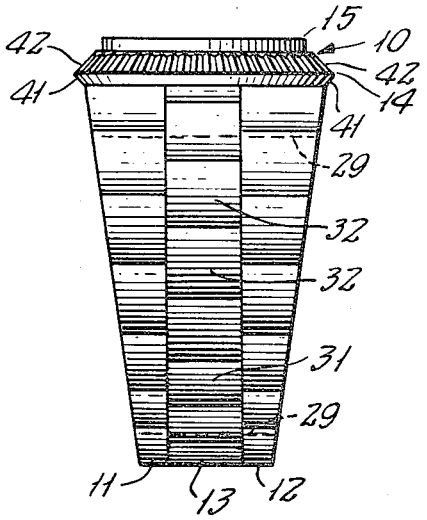
FIG. 2 is an end elevational view of the assembled embodiment.
Figure 3:
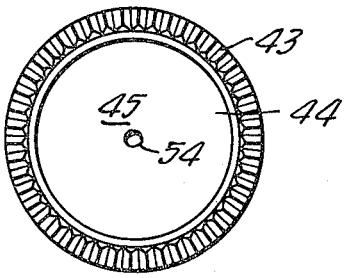
FIG. 3 is a plan view of a bezel element comprising a part of the disclosed embodiment.

In accordance with the invention, the device, generally indicated by reference character 10, comprises broadly: first and second outer band members 11 and 12, respectively, a third or central band member 13, a bezel member 14 and a signet or insert member 15.

The band members 11 and 12 are similar, and in assembled condition they are symetrically disposed. Each includes a first outer tapered surface 21, a second inner surface 22, and a peripheral surface 23, which, in the preferred embodiment, is provided with a plurality of curved areas 24 which simulate the individual links of a watch band. These terminate to communicate with an uppermost planar area 25 communicating with a portion 26 which simulates a watch case. Plural upper surfaces 28 underlie the bezel member 14. An inner peripheral surface 29 is of generally circular configuration.

The third band member 13 is adapted to be positioned between the first and second band members 11 and 12. It includes an outer peripheral surface 31 having curved areas 32 which are positioned in staggered relation with respect to the areas 24 on the first and second members, to create the impression of watch band links. The end surfaces 30 are parallel, and the inner peripheral surface (not shown) corresponds to the surfaces 29 on the first and second band members.

To provide for convenient integration, each of the members 11–13, inclusive is provided with upper bores 35 and lower bores 36 which are selectively alignable, and maintained in such alignment by elongated pins 37 and 38 which are force fitted or soldered in position.

The bezel member 14 is generally circular in configuration, and is bounded by first and second conical surfaces 41 and 42, the latter of which may include decorative facets 43. The member 14 defines a cylindrical recess 44 having a lower surface 45. A depending alignment pin 46 engages a corresponding bore 47, preferably disposed in the third band member 13 therebeneath.

The signet or insert member 15 is of disc-like configuration, and is bounded by an upper surface 50, a peripheral surface 51, and a lower surface 52, from which a downwardly extending alignment pin 53 projects. The pin 53 engages a recess 54 in the lower surface 45 of the bezel member 14.

Assembly of the device 10 will be apparent from a consideration of the drawing. The three band members 12–14, inclusive, are first assembled, using the pins 37 and 38, following which the bezel member 14 is positioned thereabove, the parts being maintained in mutually assembled condition by soldering or epoxy adhesives. The signet member 15 is then positioned within the recess 44, or, if desired, it may be replaced by a jewel cluster (not shown) or other decorative element. It will be observed that, were it desired, the third member 13 may be formed from a metal having a color which contrasts with that of the band members 11 and 12, or with that of the bezel member 14, within the spirit of the invention.

I wish it to be understood that I do not consider the invention limited to the precise details of structure shown and set forth in this specification, for obvious modifications will occur to those skilled in the art to which the invention pertains.

I claim:

1. A composite finger ring comprising: first and second outer band members, each bounded by inner and outer end surfaces and a decorative peripheral surface simulating individual links in a watchband, the peripheral surface of either of said outer members presenting the simulated individual links symmetrically disposed to the other; a single centrally disposed band member positioned between the inner surfaces of said first and second outer band members, said inner band member including opposed parallel end surfaces and a peripheral decorative surface simulating individual links in a watchband, the simulated individual links of said inner band being disposed in staggered configuration relative to that of said first and second outer members so that the band members will present, in composite, the appearance of such watchband; each of said first, second and single band members having aligned transversely extending bores, and alignment pin means engaging said bores whereby to integrate said band members, said band members each having an exposed planar surface in mutually co-planar relation; a bezel member having a planar lower surface in abutted relation to said last mentioned upper planar surfaces, and having at least one depending alignment pin, one of said upper surfaces having a corresponding bore in which said pin is engaged.

2. The construction in accordance with claim 1, further characterized in said bezel member having an upwardly facing recess, and a decorative plate disposed in said recess.

3. The method of making a decorative ring externally resembling a wristwatch case and interconnected linked band comprising the steps of:

providing first and second outer band members, each having an inner and outer end surface, and a mutually matching decorative peripheral surface simulating individual links of a linked watchband;

providing a third central band member having first and second end surfaces and a non-matching decorative peripheral surface simulating individual links of a linked watchband;

providing alignable bores in said band members, and interconnecting said band members together in predetermined relation to present, in composite, the appearance of such linked watchband, using pins engaging said bores;

providing a mutually coplanar surface on each of said integrated band members;

providing a bezel member having a lower planar surface, and securing said bezel member at said lower surface to said coplanar surfaces of said band members.

* * * * *